United States Patent [19]

Sundstrom

[11] 4,186,649

[45] Feb. 5, 1980

[54] REGULATORS

[75] Inventor: Nils E. Sundstrom, Sodertalje, Sweden

[73] Assignee: AB Westin & Backlund, Stockholm, Sweden

[21] Appl. No.: 773,298

[22] Filed: Mar. 1, 1977

[30] Foreign Application Priority Data

Mar. 3, 1976 [SE] Sweden ..... 7602985

[51] Int. Cl.[2] ..... F01B 7/00; F15B 15/24

[52] U.S. Cl. ..... 91/170 R; 92/13.2; 92/13.3; 92/62

[58] Field of Search ..... 91/167 R, 178, 170 R; 92/13.3, 13.6, 62, 63, 129, 150, 151, 13.2

[56] References Cited

U.S. PATENT DOCUMENTS

| | | | |
|---|---|---|---|
| 2,230,914 | 2/1941 | Sherman | 92/13.3 |
| 2,969,042 | 1/1961 | Litz | 92/13.3 |
| 3,385,172 | 5/1968 | Kaminga | 92/151 |
| 3,805,669 | 4/1974 | Mitchell | 92/63 |
| 3,913,457 | 10/1975 | Hawley | 91/167 R |

FOREIGN PATENT DOCUMENTS

| | | | |
|---|---|---|---|
| 2425371 | 4/1975 | Fed. Rep. of Germany | 92/62 |

*Primary Examiner*—Hershkovitz
*Attorney, Agent, or Firm*—Strimbeck & Soloway

[57] ABSTRACT

A regulator for regulating the output of an output shaft is discosed, the regulator comprising a number of chambers to and from which working medium can be fed and discharged in dependence upon control means to effect axial movement of the output shaft via pressure transmitting elements.

In accordance with the invention, the regulator comprises a number of series-connected units, the units providing fixedly spaced walls to define separated chambers through which the output shaft effectively extends, each chamber having at least one pressure transmitting element therein which is connected directly or indirectly to said output shaft. With such an arrangement the or each pressure transmitting element, when activated, exerts either individually or in unison an axial force on the output shaft substantially corresponding to the sum of the forces exerted on the active pressure transmitting elements. Adjustable stop means are preferably provided for the pressure transmitting elements, and are adjustable via setting and locking means for each length of stroke of the regulator.

The regulator may be constructed from a number of module units, each module unit defining a chamber and having a pressure transmitting element of the preceding unit displaceably mounted therein, each element having a shaft co-operating with the pressure transmitting element of the preceding unit and the shafts in combination providing said output shaft.

4 Claims, 5 Drawing Figures

Figure 1:
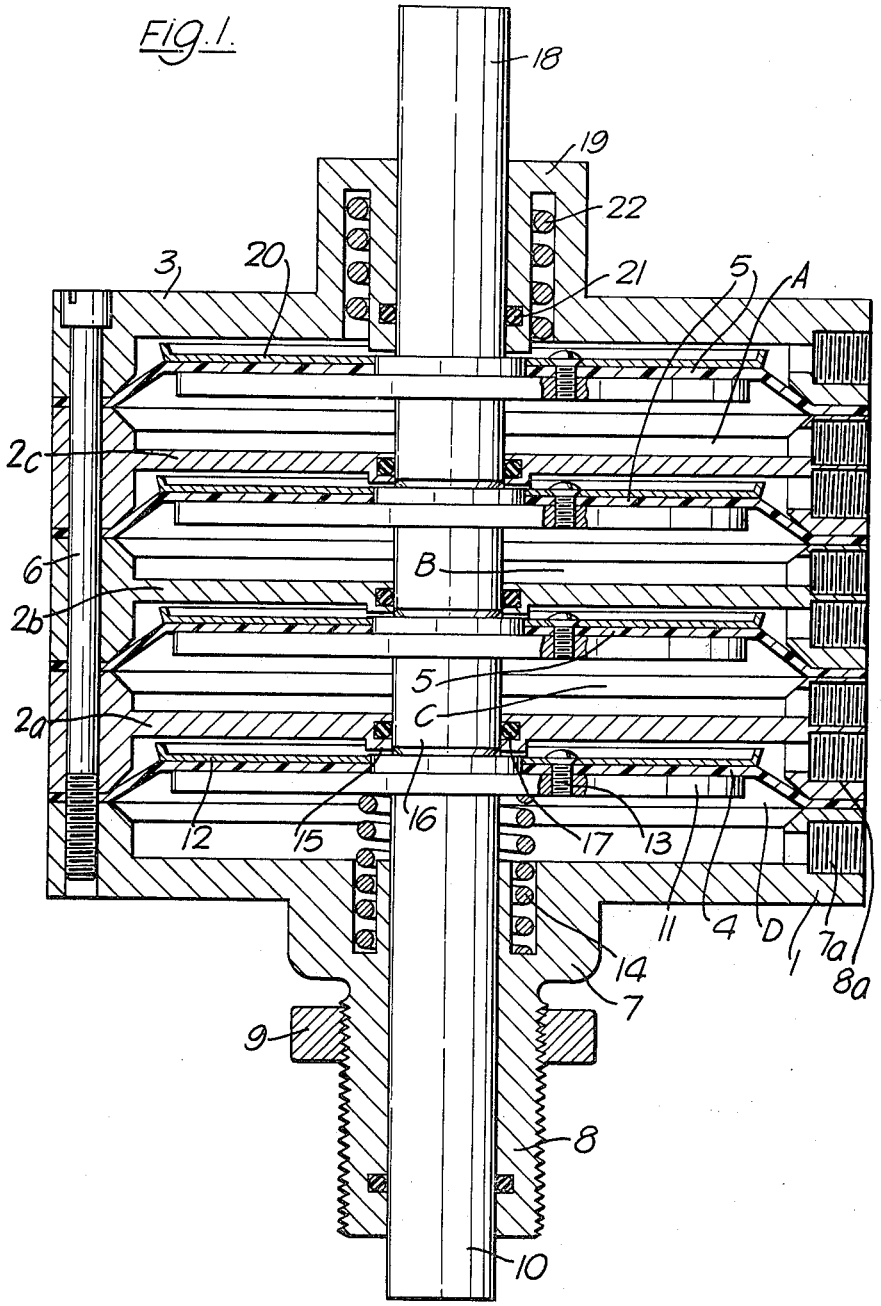

18
19
22
21
3
20
5
A
2c
6
B
2b
5
2a
C
12
15
16
17
13
11
4
D
1
7a
8a
14
7
9
8
10

REGULATORS

The present invention relates to a regulator comprising a number of chambers to which a working medium can be fed and from which said working medium can be discharged in dependence upon control means, for axially moving, via pressure-transmitting elements, an output shaft displaceably mounted in the body of the regulator.

It is known within the art to use different types of servo-systems or force-amplifying devices to perform the movement of mechanical elements. Such force amplifiers are normally hydraulically or pneumatically regulated via control means. Hydraulic force amplifiers normally comprise sealed piston-cylinder arrangements, while pneumatically regulated amplifiers often comprise pressure chambers in which pressure-transmitting diaphragms or bellows are arranged.

The force transmitted by a force-amplifier is dependent upon the specific pressure of the working medium and the working area over which the pressure acts. Consequently when large forces are to be transmitted, this working area, and consequently also the force amplifier, must have relatively large external dimensions. A force-amplifier thus constructed is dimensioned to provide large forces and only in exceptional cases can such an amplifier be used to carry out work which requires small forces. Any variation in the force transmitted by such an amplifier, can only be regulated by varying the pressure of the working medium. This greatly restricts the use of such a force-amplifier.

An object of the present invention is to provide a force-amplifier which can be used to transmit forces within at least two specific force ranges, without varying the pressure of the working medium.

The invention is characterized in that the regulator comprises a number of units connected in series, said units being formed by fixedly spaced walls which define mutually separated chambers, in that the output shaft effectively extends through the chambers, and in that each chamber has disposed therein at least one pressure-transmitting element connected directly or indirectly to said output shaft so that the or each element, when activated, is arranged to exert, either individually or in unison, an axial force on said output shaft substantially corresponding to the sum of the forces exerted on the active pressure-transmitting elements.

The pressure-transmitting element of one chamber may be larger than the pressure-transmitting element of another chamber, thereby enabling the power output of the regulator to be adjusted at will without varying the pressure of the working medium.

The pressure-transmitting elements of respective chambers may either be single-acting or double-acting. In the former case, the working medium will cause a respective pressure-transmitting element to move in one direction only, and the return movement of said element to its starting position is effected by means of a biassing force, while in the latter case the working medium will cause respective elements to move first in one direction and then in the reverse direction under the control of means arranged to regulate the flow of working medium to and from a respective chamber.

In order that the invention will be more readily understood and optional features thereof made apparent, exemplary embodiments of the invention will now be described with reference to the accompanying drawings, in which:-

Figure 2:
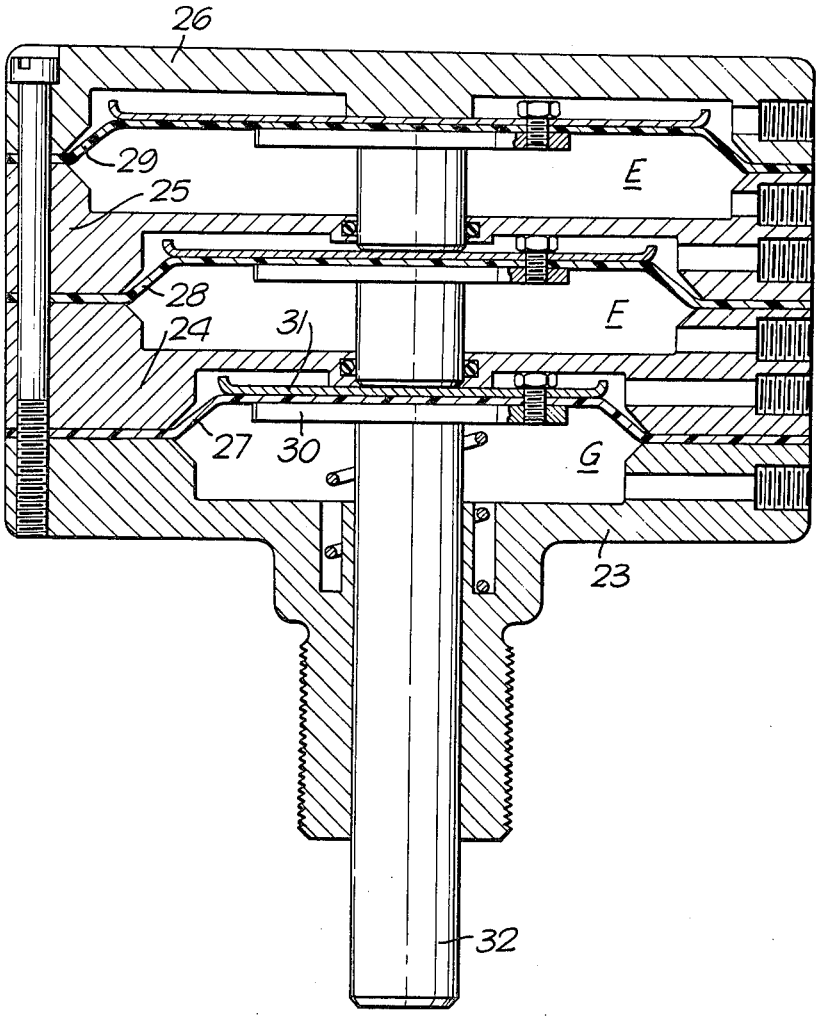
Figure 3:
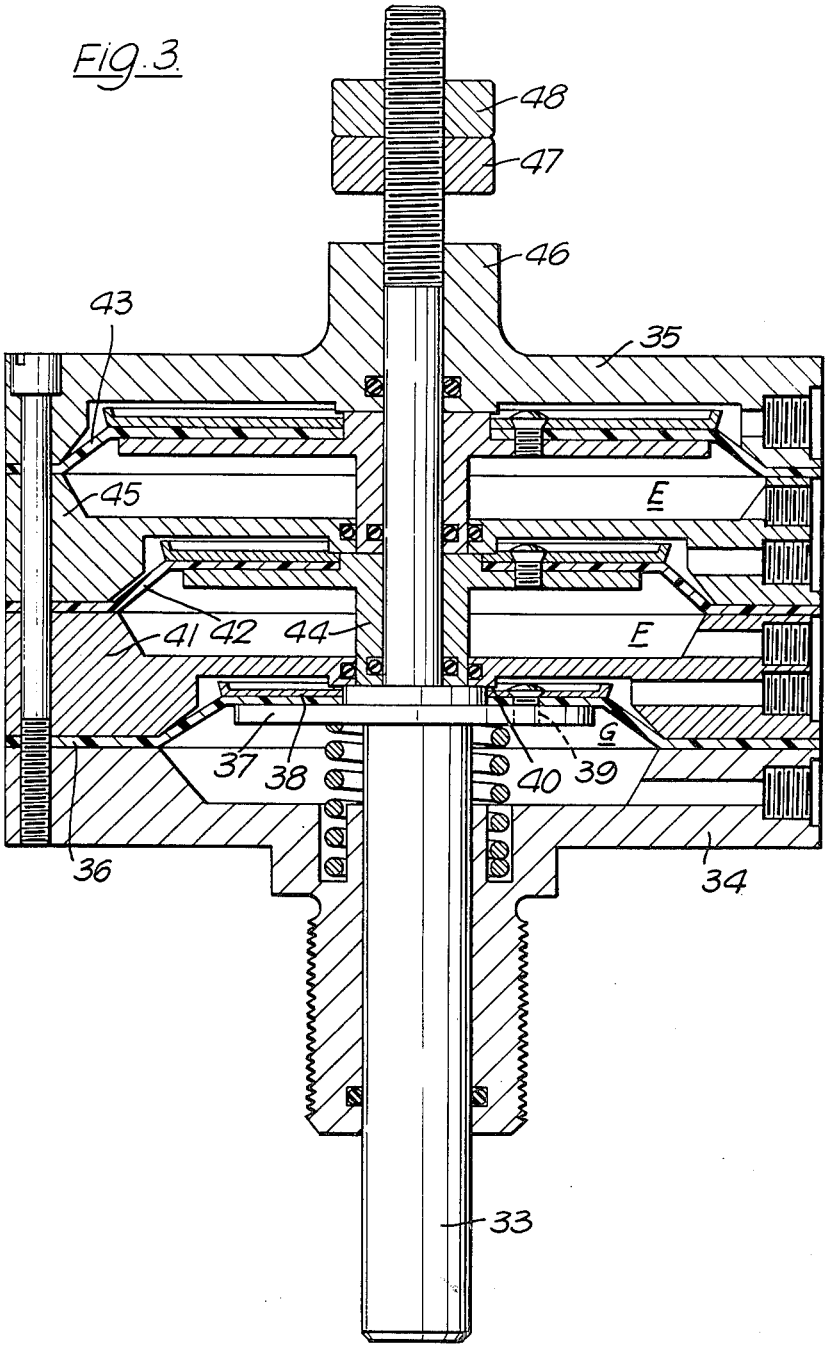
Figure 4:
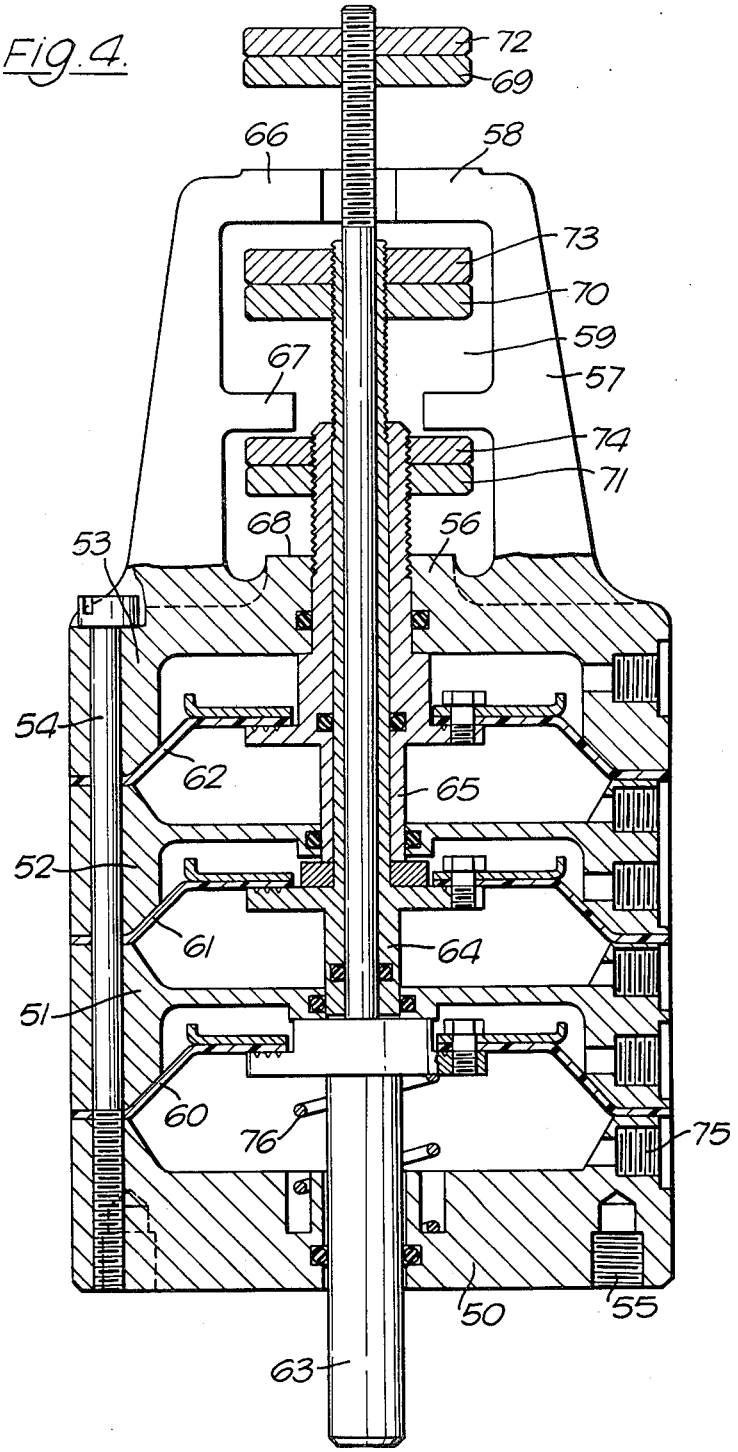
Figure 5:
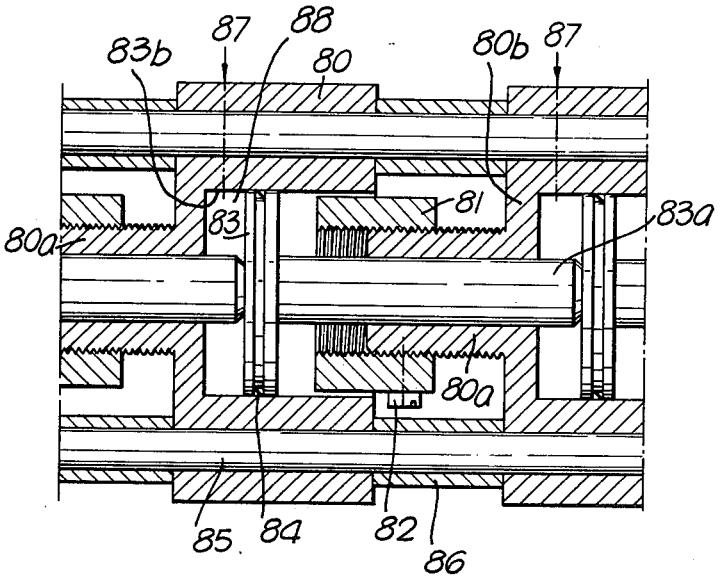

FIG. 1 is a longitudinal sectional view of a regulator having four working chambers of substantially equal volume, each of which chambers has a pressure-transmitting diaphragm arranged therein, FIG. 2 is a view of a regulator having three chambers of mutually different size, FIG. 3 is a modified embodiment of the regulator shown in FIG. 2, this modified regulator being provided with stop means for the output shaft of the regulator, FIG. 4 is a longitudinal sectional view of a regulator provided with diaphragms and having an individually adjustable stop means for each diaphragm, and, FIG. 5 is a partially longitudinal sectional view of a regulator comprising a plurality of modular units.

The regulator shown in FIG. 1 comprises a basic body structure comprising five units or elements, these being a front wall 1, three uniformly spaced intermediate walls 2*a*, 2*b*, and 2*c* and a rear wall 3, said elements together forming four mutually separated chambers A–D. The intermediate walls 2 and also the end walls 1 and 3 have a substantially cylindrical external shape. The intermediate walls 2*a*–2*c* are in the form of plates and are of practically symmetrical design with a thin-wall hub-like centre portion which, at its periphery, merges with an abutment-like encircling ring having two side surfaces. The transition region between the hub-like centre portion and the encircling ring is, on both sides, radially inwardly shaped with a chamfer to approximately half the depth between respective side surfaces of the ring and the hub-like centre portion. The inner surfaces of the front wall 1 and the rear wall 3 are also provided with a corresponding cylindrical recess and chamfer.

A diaphragm 4, 5 is arranged between the front wall and the intermediate wall 2*a*, and also between the intermediate walls 2*a* and 2*b* and 2*b* and 2*c* respectively and between the intermediate wall 2*c* and the rear wall 3. The elements or units are joined together by means of a number of screws 6 uniformly spaced around a circle and passing axially through said elements, which elements together form the body of the regulator with four chambers A–D of substantially the same volume defined therein.

The front wall is provided with a hub 7 and a cylindrical neck 8. The latter is provided with screw-threads and a locking nut 9 for connecting the regulator to a reaction-force absorbing element. Displaceably mounted in the neck 8 and the hub 7 is a main shaft 10 forming the output shaft of the regulator. The inner end of the shaft 10 is fixedly connected to a front pressure plate 11 to which the diaphragm 4 in the front chamber D is connected by means of a rear pressure plate 12 and a multiplicity of rivets 13 or the like arranged at spaced positions around a circle. The diaphragm unit divides the front chamber D into two pressure chambers, a front and a rear pressure chamber, each of which is connected with control means (not shown) in a pressure-medium circuit via a radial channel 7*a*, 8*a* and a connecting line (not shown). By passing working medium alternately to one chamber and the other, the shaft 10 can be caused to move axially in either direction, the chamfers on the front wall 1 and the intermediate wall 2*a* affording the requisite freedom of movement of the diaphragm 4.

When the regulator is to be a single-acting regulator, i.e., when the working medium is to act on the diaphragm 4 so as to cause axial movement in only one direction, the diaphragm unit must be returned by means of a biassing force. In this case, there is arranged between the inner surface of the front wall 1 and the pressure plate 11 a compression spring 14 which biasses the diaphragm unit into abutment with an abutment surface 15 on the intermediate wall 2a, in the absence of pressure in the rear pressure chamber.

The other chambers A–C are connected to the working medium circuit in a manner similar to the chamber D and, similarly to the attachment of the diaphragm 4 to the output shaft 10 in chamber D, the diaphragms 5 in chambers A–C are fixedly connected to a shaft 16 which is displaceably mounted in a bore extending through a preceding intermediate wall 2. The lead-through or bush through which the shaft 16 passes is sealed by means of a seal 17, and each shaft 16 is arranged to move axially so as to act on the preceding diaphragm unit. With such an arrangement, the output shaft can be caused to move axially in dependence upon the individual pressures prevailing in respective chambers A–D, and therefore the pressure regulator can operate within four different force areas.

The regulator can also be provided with a further rearwardly extending output shaft 18. In the embodiment of FIG. 1, the shaft 18 is displaceably mounted in a hub 19 formed on the rear wall 3 and is attached to a pressure plate 20 arranged in the chamber A. The bush through which the shaft passes is sealed by means of a seal 21 and a compression spring 22 is arranged between the hub 19 and the pressure plate 20, said spring biassing the pressure plate and the shaft 18 into abutment with the diaphragm unit in chamber A. In the case of a single-acting regulator the spring 22 is weaker than the spring 14.

In the regulator shown in FIG. 2, the body of the regulator comprises four fixedly spaced and connected elements, these being a front wall 23, two intermediate walls 24, 25 and a rear closed wall 26.

The regulator of FIG. 2 is of the same construction as the regulator previously described, but differs from the latter regulator with regard to the relative volumes of respective chambers. The chambers E-G of the regulator shown in FIG. 2 exhibit diametrical differences, in that the recesses in the front wall 23 and rear wall 26 respectively, as well as the recesses in the intermediate walls 24, 25, are not of equal size. Because the chambers thus formed are of mutually different size, the active pressure surfaces of the diaphragms 27, 28, 29 of respective chambers E-G are different and, in view thereof, require pressure plates 30, 31 of different size in respective pressure chambers. In all other respects the regulator shown in FIG. 2 is the same as that shown in FIG. 1.

A regulator constructed in the manner shown in FIG. 2 provides a differential power transmission, the force transmitted depending upon which chamber E-G has been supplied with pressure medium, and by selectively controlling the feed of working medium to the chambers it is possible to operate the output shaft 32 of such a regulator within seven different ranges of force.

The regulator shown in FIG. 3 is also constructed to provide differential power outputs, i.e., the regulator has a multiplicity of mutually separated diaphragms exhibiting pressure surfaces of different areas, these diaphragms acting on one and the same output shaft. The difference between the regulator shown in FIG. 2 and that shown in FIG. 3 resides in the fact that the embodiment of FIG. 3 is provided with a through-passing main shaft 33 which is displaceably mounted in a front wall 34 and a rear wall 35. Similar to the embodiments previously described, there is mounted on the main shaft 33 a diaphragm 36 which operates in the front chamber G. The diaphragm is mounted by means of two pressure plates 37, 38 and a multiplicity of screws 39 spaced around a circle. The main shaft 33 is provided with a flange which abuts an abutment surface 40 on the intermediate wall 41 to determine the starting position of the main shaft 33.

The diaphragms 42, 43 in the other two chambers E-F are mounted in a similar manner on hollow-tubular shafts 44. These shafts are displaceably mounted on the main shaft 33 and in a bore or bush extending through a preceding intermediate wall 41, 45. The shaft bushes are sealed in a conventional manner with sealing rings.

The rear wall 35 is provided with a hub 46 and externally thereof adjustable stop means are screwed on to a threaded portion of the main shaft 33, said stop means comprising a setting nut 47 and a locking nut 48. By adjusting the axial position of said stop means on the shaft it is possible to limit the total length of stroke of the regulator. The possibility of such adjustment has importance in limited spaces.

FIG. 4 shows a further embodiment of a regulator which substantially comprises a combination of the previously described embodiments but which, in addition, is provided with separate adjustable stop means for each diaphragm. The body of the regulator comprises four fixed elements or units, similar to the previously described embodiments. Thus the body comprises a front wall 50, two intermediate walls 51, 52 and a rear wall 53, which are held together by a number of axially extending screws 54. The front wall 50 has a planar front surface in which a number of tapped holes 55 are arranged to receive screws by which the regulator can be attached to a reaction force absorbing element. The outer surface of the rear wall 53 is provided with a hub 56 and a holder 57 connected thereto. The holder 57 has the form of a plate which extends laterally over the rear wall 53. The holder 57 tapers rearwardly in the axial direction to form a closed stirrup-like structure with an opening 59 between the hub 56 and the web 58 of the stirrup.

Arranged in respective chambers of the regulator are diaphragms 60, 61, 62, said diaphragms being mounted on a main shaft 63 and on respective hollow-tubular shafts 64, 65 in the same manner as that described with reference to FIG. 3, and hence the following description of the FIG. 4 embodiment will be restricted to those differences in the construction of the FIG. 4 embodiment vis-a-vis the embodiments previously described. In this regard, the regulator is provided with an output shaft 63 extending through the front wall 50, the rear wall 53 and the rear holder 57. In the front chamber, the main shaft 63 is connected to the diaphragm 60, while the diaphragm 61 in the intermediate chamber is mounted on a tubular shaft 64 displaceably mounted on the main shaft 63 and extending axially through the rear wall 53 into the holder opening 59. The diaphragm 62 in the rear chamber is mounted on a tubular shaft 65 displaceably mounted on the tubular shaft 64, said shaft 64 extending in a displaceable manner axially through the rear wall 53 into the holder opening 59.

The thus telescopically mounted shafts 63, 64, 65 extend axially rearwardly to different extents. Mounted on the respective outer ends of said shafts are individually adjustable stop means arranged to coact with fixed stop shoulders 66, 67, 68 or the like on the rear holder 59 to regulate the respective length of strokes of the diaphragm 60, 61, 62. The stop means comprise pairs of adjusting nuts and locking nuts 69, 72; 70, 73 and 71, 74 respectively.

The regulator shown in FIG. 4 is intended to be connected to a compressed-air circuit in which it is possible to feed compressed air by control means (not shown) to selected chambers via radial channels 75. As will be understood from the aforegoing, the diaphragms 60, 61, 62 can be displaced axially either individually or in unison. When occupying its starting position, the main shaft 63 abuts a shoulder on the intermediate wall 51 under the action of a compression spring 76 arranged between the front wall 50 and a flange on the main shaft 63, the tubular shafts adopting starting positions in dependence thereupon. When the stop means are adjusted in a manner to give the shafts 63, 64, 65 the same setting, it is immaterial to which chamber the compressed air is fed, since each chamber will provide the same degree of force amplification. If, on the other hand, the stop means of respective shafts are given mutually different settings, respective chambers will also provide varying degrees of force amplification, which affords significant advantages when carrying out complicated working operations. A regulator having individually adjustable stop means does not exclude the use of the regulator as a treble-stage device operating within three different ranges of force.

The diaphragms are suitably made of a leather, plastics or rubber material, or may also be made of metal. The diaphragms are preferably planar in shape permitting axial displacement movements, although the diaphragms may also comprise so-called roller diaphragms or bellows.

As will be apparent from the above, the regulator according to the invention comprises a number of units forming fixed walls which define mutually separated chambers. The pressure-transmitting elements in respective chambers are arranged to exert, either individually or in unison, an axial force on the output shaft of the regulator, this force substantially corresponding to the sum of the forces exerted on the active pressure-transmitting elements. In the embodiment shown in FIG. 1 and 4. identical units are incorporated between the end walls of the regulator, thereby enabling the regulator to readily adapt to different force requirements by varying the number of intermediate units.

In order to rationalize the construction of the regulator still further, thereby to render the regulator suitable for different field of use and force requirement, the regulator may advantageously comprise a number of module units arranged in series. Such an embodiment is shown in FIG. 5.

In FIG. 5, each module unit comprises a cylinder body 80 having a fixed end wall **80*b* and in which there is mounted an external hub 80*a* provided with external screw threads. Arranged on the hub 80*a* is a setting sleeve 81 which, by rotation, can be caused to adopt different axial positions relative to the cylinder body 80. The setting sleeve 81 can be locked in its adjusted position on the hub 80*a* by means of a setting screw 82 mating with a screw thread on the hub 80*a*. A piston rod 83*a* is displaceably mounted in bores extending through the hub 80*a* and the fixed end wall 80*b* of the cylinder body 80, said piston rod 83*a* being fixedly connected to a piston 83. The piston 83 fits in a cylindrical recess 83*b* formed in the end wall 80*b* of an adjacent cylinder 80 and there is formed between the piston and said fixed end wall a pressure chamber 88, the piston having a piston seal 84 which seals against the inner cylindrical surface of the cylinder. The pressure chamber is in communication with a source of pressure medium (not shown) via an inlet line 87, shown only schematically in FIG. 5. Thus, when working medium is supplied to a pressure chamber 88 in a cylinder body 80, a force is exerted on the piston 83 causing the same to move axially, the outer end of the piston rod 83*a* of all but the leading unit being urged into abutment with the piston 83 in a preceding cylinder body 80, said piston rods in combination providing the output shaft of the regulator. Axial movement of each piston 83 is limited by abutment with the end of the setting sleeve 81 screwed onto the outer hub 80*a* of a preceding cylinder body 80** and axially fixed on said hub.

When the pressure in the pressure chamber 88 falls, the piston 83 and the piston rod **83*a* are returned to a fixed starting position under the bias of a spring. This spring bias can be provided by connecting to the leading module unit in the series which comprise the regulator an outer wall (not shown) which, similarly to the embodiments of FIGS. 1–4, comprises guides for an axially compression spring (not shown). This spring bias, however, can also be provided by spring biassing means which are incorporated in the mechanical devices which the regulator is intended to serve in use. A regulator can be constructed comprising at least two module units having connecting means in the form of shaft 85 extending through the cylinder bodies 80. Arranged on the shafts 85 between the cylinder bodies 80 are distance pieces in the form of sleeves 86 and mounted on respective ends of the shafts 85** are washers and nuts (not shown) by which the units can be drawn together to form a compact assembly. By regulating the supply of working medium to one or more pressure chambers, the output shaft of the regulator can be subjected to different forces, to cause the shaft to move axially. This is an advantage of extreme significance when it is desired to provide a small force as a holding means during a setting operation and then to be able to apply a much larger force so as to lock said set position.

By setting the setting sleeve 81 to different axial positions, the outer end of the ouput shaft of the regulator can also be caused to adopt different settings depending upon to which pressure chamber the working medium has been supplied, and it is also possible to regulate said end positions stepwise by alternatively coupling the supply of working medium to respective pressure chambers in the cylinders 80.

As will be understood from the above, the regulator according to the invention can be adapted for use in a multiplicity of different fields and may have modified forms. Thus, the regulator can be used both as a position regulator and as a power regulator and the pressure transmitting elements in respective units may be pistons and/or diaphragms actuated by hydraulic and/or pneumatic working media. The invention is therefore not restricted to the described embodiments but can be modified within the scope of the following claims.

I claim:

1. In a regulator comprising a number of units connected in series, each of which units comprise a fixed body, and, for axial movement, a pressure transmitting element displaceable relative to that body, said pressure transmitting element via a shaft cooperating with the pressure transmitting element of the next adjacent said unit and said shaft in combination with the shafts of the other said units providing an output shaft that effectively extends through the regulator, said units when assembled defining a corresponding number of pressure chambers to which a working medium can be fed and from which said working medium can be discharged in dependence upon control means, the improvement which comprises: (a) said fixed body in each unit has a pressure wall and an open end, (b) between the pressure wall and the pressure transmitting element there is defined a said pressure chamber, (c) there is provided for the output shaft of each pressure chamber of each said unit a stop means is (i) adjustable over a range of movement for limiting axial movement of its associated pressure transmitting element (ii) located outside of each said pressure chambers of the regulator, and (iii) comprises setting and locking means and (d) said pressure wall of each fixed body has an external hub along which a sleeve can be adjusted in continuous manner to adopt different axial positions relative to the fixed body, thereby affording said adjustable stop means.

2. In a regulator according to claim 1, the improvement wherein said hub and said sleeve extend into the said open end of the next adjacent said fixed body.

3. In a regulator according to claim 2, the improvement wherein said pressure transmitting element comprises a piston with a piston rod constituting its said shaft, said piston rod being displaceably mounted in aligned bores extending through said hub and the pressure wall of the next adjacent fixed body.

4. In a regulator according to claim 3, the improvement wherein said fixed bodies are module units having an outwardly cylindrical form, said units being connected in spaced relationship via distance pieces.

* * * * *

UNITED STATES PATENT AND TRADEMARK OFFICE

CERTIFICATE OF CORRECTION

PATENT NO. : 4186649

DATED : February 5, 1980

INVENTOR(S) : Nils E. Sundstrom

It is certified that error appears in the above-identified patent and that said Letters Patent are hereby corrected as shown below:

Claim 1, column 7, line 17, the term "which" should be inserted after "means".

Signed and Sealed this

*Thirteenth* Day of *January 1981*

[SEAL]

*Attest:*

SIDNEY A. DIAMOND

*Attesting Officer*

*Commissioner of Patents and Trademarks*